United States Patent [19]

Mista et al.

[11] 4,075,744

[45] Feb. 28, 1978

[54] THREAD TESTING APPARATUS FOR TEXTILE MACHINES

[75] Inventors: Kresimir Mista; Ditmar Gerstner-Stevens, both of Obertshausen, Germany

[73] Assignee: Karl Mayer Textilmaschinenfabrik GmbH, Obertshausen, Germany

[21] Appl. No.: 724,505

[22] Filed: Sep. 20, 1976

[30] Foreign Application Priority Data

Oct. 2, 1975 Germany ..... 2543983

[51] Int. Cl.[2] ..... D01H 13/22

[52] U.S. Cl. ..... 28/224; 242/35.6 R; 242/36

[58] Field of Search ..... 28/64, 1.4, 62, 72 R; 242/35.6 R, 36; 73/160

[56] References Cited

U.S. PATENT DOCUMENTS

| | | | |
|---|---|---|---|
| 3,335,476 | 8/1967 | Pitts et al. | 28/64 |
| 3,396,442 | 8/1968 | Gilmore | 28/1.4 |

*Primary Examiner*—Louis K. Rimrodt
*Attorney, Agent, or Firm*—Behr & Woodbridge

[57] ABSTRACT

The thread testing apparatus of a textile spooling machine is equipped with a thread inserter which is responsive to knots formed in the thread. In a typical thread testing apparatus a flaw is detected in a fault sensing zone whereupon the thread is cut, the flaw is removed and the loose ends of the good thread are reunited with a knot. Due to the nature of the sensing mechanism, it is not desirable to place the reunited thread back in the fault sensing zone until the thread starts moving again. The thread inserter of the present invention accomplishes this function by detecting the presence of the reuniting knot with a slot having a width smaller than the knot, but larger than the average width of the thread. The thread inserter also includes a slough off means for guiding the thread back to the falt sensing zone and a magnetic means for biasing the thread inserter in a first knot detecting position.

7 Claims, 4 Drawing Figures

THREAD TESTING APPARATUS FOR TEXTILE MACHINES

BACKGROUND OF THE INVENTION

1. Field of the Invention

This invention relates to an improved method of detecting flaws in a thread and, more particularly, to a thread inserter which will detect the knot in the reunited thread and subsequently insert the thread back into the fault sensing zone of the thread testing apparatus.

2. Description of the Prior Art

Devices are known in the prior art for detecting faults in a thread or yarn. Typically when the fault is detected, the yarn is then cut and the faulty area removed. The thread is then reunited with a knot and the spolling or knitting operation continues. One difficulty with prior art devices is that the fault sensing mechanism often has the inability to distinguish between short and long variations in thread size when the thread is motionless in the sensing zone. This can occur, for example, immediately following a thread uniting sequence when the thread is fed laterally into the sensing zone of the detecting device with little or no forward motion. Thus, a short thread imperfection which remains in the sensing zone for an extended period of time until the winding recommences is often treated by the sensing apparatus as identical to an elongated imperfection of the cross section in an advancing strand of thread. This may result in the thread being severed when, in fact, the true nature of the fault is such as to render that section of the thread as acceptable for winding.

One solution to the foregoing problem is discussed in detail in U.S. Pat. No. 3,389,867 entitled "Textile Apparatus" and issued on June 25, 1968 to Thomas E. Pitts. Since many of the features described in U.S. Pat. No. 3,389,867 are similar or identical to many of those which form a part of this invention, that patent is hereby incorporated in its entirety into this specification by reference. The Pitts' invention includes a delay mechanism which insures that the thread is moving before it reenters the sensing zone subsequent to its being reunited. If the delay is long enough, the knot itself may not enter the sensing zone or if it does enter the sensing zone is may be acceptable since the thread is moving.

Pitts provides two mechanisms for delaying the threads reentry into the sensing zone. One mechanism comprises a helical screw which rotates as the thread comes up to speed. Eventually the moving thread climbs to the top of the screw and naturally springs into the sensing zone. According to another embodiment an inclined cylinder is employed to delay the reentry of the thread into the sensing zone. One of the problems with such prior art devices is that they are difficult to correctly set in order to achieve thread reentry into the cutting zone at the appropriate point in the machine cycle. In addition, such delay devices frequently operate with "slippage" so that there are many unnecessary interruptions in the running of the machine and consequently many resettings are necessary. In addition to the foregoing the present invention is believed to be a simple and more efficient approach to the problem just described.

SUMMARY OF THE INVENTION

Briefly described, the invention comprises an apparatus for reinserting a reunited thread back into the fault sensing zone of a textile spooling machine. In a typical winding operation the thread passes from one spool through a fault sensing zone and is subsequently rewound on another spool. If a flaw is detected in the thread, the thread is then severed at a point before and after the flaw and then reunited in a knot in a manner known to those of ordinary skill in the art. Accordingly the present invention comprises an apparatus for detecting the presence of the thread reuniting knot and for inserting the reunited thread back into the fault sensing zone in such a manner that the knot does not produce a false flaw reading in the sensing zone. The thread inserting apparatus includes a slotted portion having a minimum width which is smaller than the predetermined size of the reuniting knot, but smaller than the average width of the thread. As the thread picks up speed, the knot impinges upon the V-shaped slot and causes the inserter mechanism to flip approximately 90° toward the fault sensing zone. At the same time a slough off arm which forms part of the thread inserter picks up the thread and guides it towards its destination. In this manner the knot may be placed in a location past the sensing zone or if it is placed in the sensing zone it may be at a time when the sensing apparatus is in a less sensitive phase. The thread inserter apparatus also includes a magnetic device for biasing the thread inserter to a first position so that it will sense the presence of a moving knot. The moving knot causes the thread inserter to flip and temporarily assume a second position whose limit is determined by a stop mechanism. These and other features of the present invention will be more fully understood with reference to the following drawings.

DESCRIPTION OF THE INVENTION

During the course of this description like numbers will be used to indicate like elements illustrated in the different views of the invention.

Figure 1:
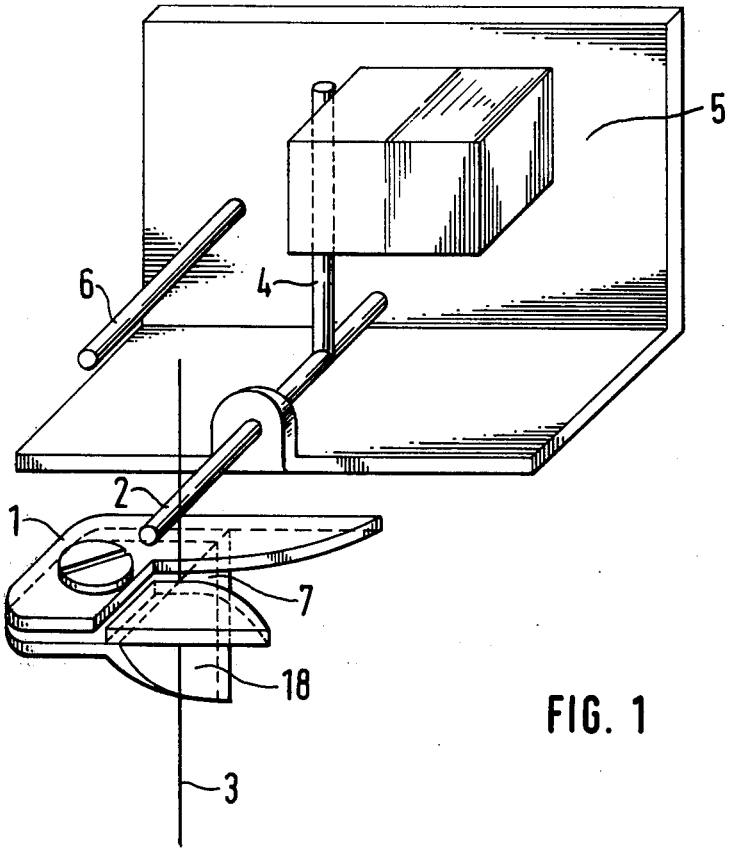
FIG. 1 is a perspective view of the thread inserter apparatus according to the present invention, which is illustrated in the context of a spooling machine.

A thread inserter 1, which could also be referred to as a thread layer, is isolated in FIG. 1. The inserter 1 is attached to a pivotal axis or axel means 2 and adapted to rotate in a plane perpendicular to the direction of travel 8 of a thread 3. The pivot axel 2 includes an extension 4 which acts as a stop bar. The extension 4 is held in an initial first position by means of magnet 5. A second stop 6 determines the limits of rotation of the inserter 1 about the axel 2. When extension 4 impinges against stop means 6 the inserter 1 is in a second position.

The inserter 1 includes a slot 7 in one portion thereof and a slough off means 18 at a position roughly 90° away from the plane of the slot 7. The thread 3 to be tested is adapted to pass through the slot 7 without impinging until such time as the slot 7 comes into contact with a knot. Accordingly the effective width of the slot 7 is slightly greater than the average normal width of the thread 3 but smaller than a knot 17.

Figure 2:
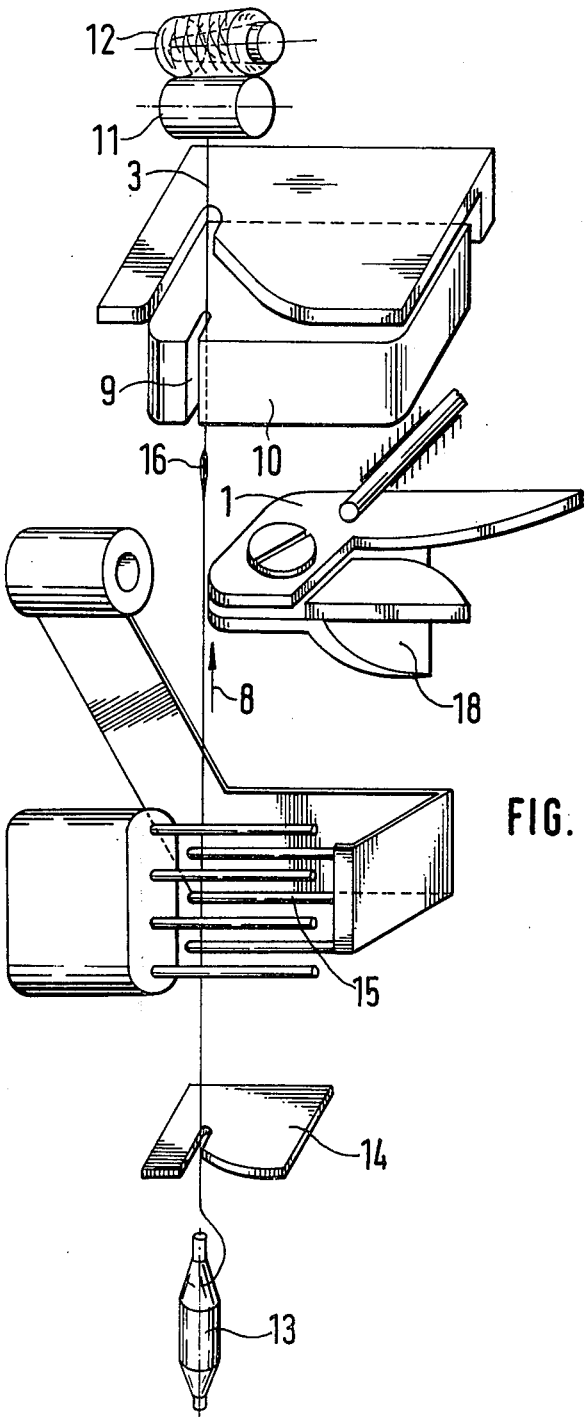
FIG. 2 is a partial perspective schematic view of a spooling machine in the area of the thread cleaner.
Figure 3:
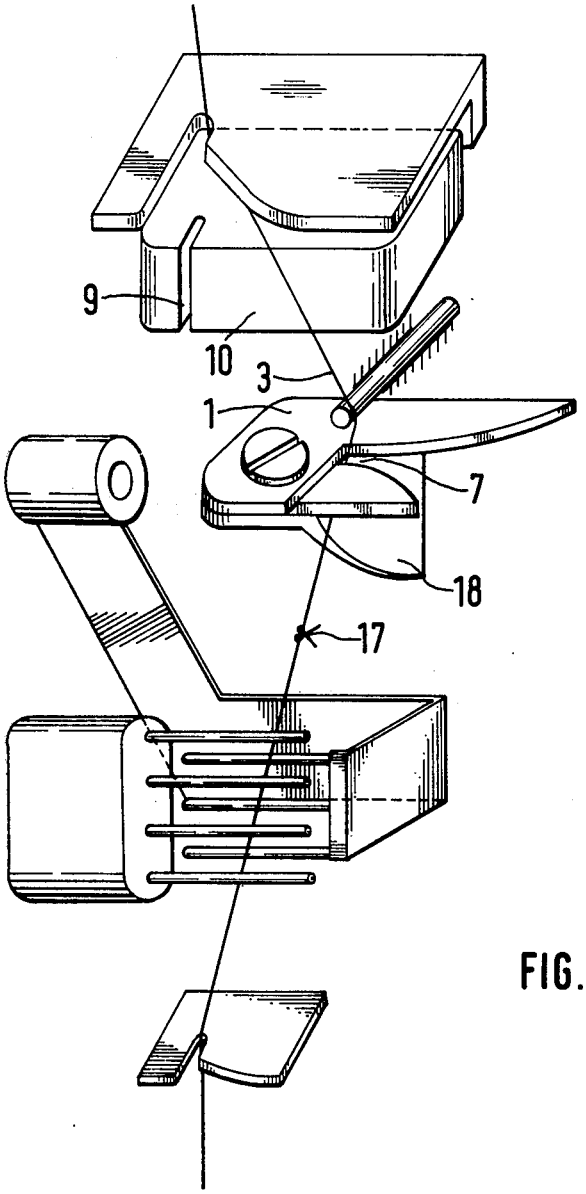
FIG. 3 is a view similar to FIG. 2, but at a later portion of the machine cycle.
Figure 4:
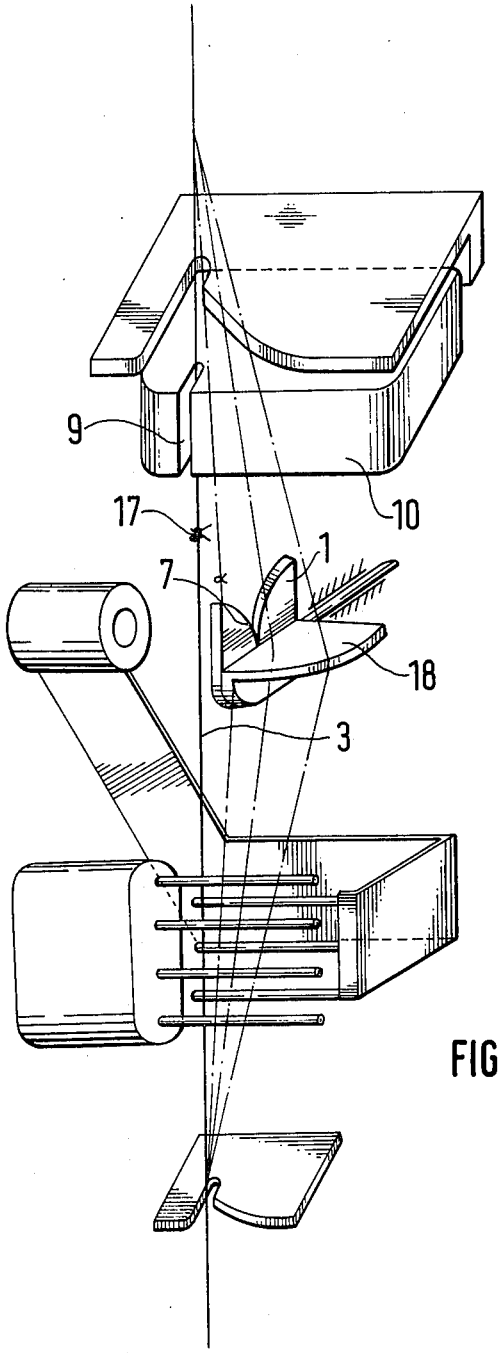
FIG. 4 is a view similar to that illustrated in FIGS. 2 and 3 but at a yet later point in the machine cycle.

The operation of the machine can be easily understood from FIGS. 2 through 4. As illustrated in FIG. 2, the thread inserter 1 is located before the engaging slot 9 of the thread cleaner 10. The engaging slot 9 acts as a fault sensing zone for locating flaws in the thread. Typically the apparatus also contains a thread cutting device, which for purposes of brevity is not illustrated in the drawings. However, thread cutting devices are well known to those of ordinary skill in the art. The machine illustrated in FIG. 2 is shown in its first testing phase prior to the detection of a thread fault 16. In a typical operation the thread 3 is fed from spool 13 through a guide slot 14 and through a thread break 15 into the vicinity of the gauging slot 9. If there are no detected flaws the thread 3 continues to travel in the direction of arrow 8 and is taken up on thread cone 12 with the assistance of element 11.

If, however, a flaw 16 is detected in the gauging slot 9, then the thread is cut and subsequently reunited with a knot outside of the sensing zone in such a manner as to completely dispose of the flaw 16. Again the mechanism for moving the thread from the sensing zone and tying it into a know are well known to those of ordinary skill in the art. U.S. Pat. No. 3,389,867, the entire specification of which is incorporated herein by reference, describes many prior art features of this invention.

The reunited thread is placed in slot 7 in a manner similar to which the mechanism described in U.S. Pat. No. 3,389,867 places a reunited thread on a delay mechanism. This situation is clearly illustrated in FIG. 3. The thread 3 is initially laid into slot 7 in such a manner that the knot 17 is located up-stream of the thread inserter 1. The machine is then in its second phase of thread testing, but the thread inserter 1 remains in its first position. The continued movement of the thread then brings the know 17 into impinging contact with the slot 7 thereby causing the thread inserter 1 to rotate into its second position as illustrated in FIG. 4. As the inserter plate 1 rotates towards its second position against stop 6 the deflecting or slough off plate 18 helps to guide the thread 3 back into gauging slot 9 of the thread cleaner 10. The fault sensing mechanism is still in its second testing phase during the time that the knot 17 runs through the gauging slot which by this time has probably reached the necessary minimum thread speed. If the knot 17 is not too large the thread 3 will pass through without the fault sensing thread cleaner providing an erroneous cutting impulse to the thread cutter, since the fault sensor is in the less sensitive second detecting phase. After the knot has passed through the gauging slot 9, the first testing phase is automatically switched in and then every flaw, even those including knots of the size of 17, will cause the thread cutter to cut the thread.

The thread inserter 1 only stays in the second position as illustrated in FIG. 4 for a brief period of time. Once it has performed its function of reinserting the thread 3 into slot 9 it automatically assumes its first position as shown in FIGS. 1 through 3 because of the biasing influence of magnet 5 upon extension arm 4.

According to one embodiment of the present invention the distance between the thread inserter 1 and the gauging slot 9 can be specifically predetermined so that the knot 17 will have left the gauging slot 9 before the cleaner 10 has developed its full sensitivity. Alternatively, it could be possible to place the reunited thread in the slot 9 in such a fashion that the knot 17 appears down stream of the fault sensing zone.

It will be noted that the present invention differs from the prior art, such as described in U.S. Pat. No. 3,389,867, in both structure and function. In particular the present apparatus does not wait a predetermined time interval before reinserting the reunited thread into the sensing zone. Rather, the time interval involved if there is any delay at all, is entirely variable depending upon the location of the reuniting knot and other factors such as machine speed.

While the invention has been described in terms of a preferred embodiment thereof, it will be appreciated by those of ordinary skill in the art that changes can be made in the apparatus without departing from the spirit and scope of the invention.

What is claimed is:

1. In a thread testing apparatus having a fault sensing zone operable to receive a strand of thread and detect faults in said thread as the strand moves through the zone along a usual strand path, the strand being removable from said zone, the improvement comprising:

a thread inserter located before said fault sensing zone and adapted to insert said thread into said fault sensing zone, said thread inserter including a knot detecting means for detecting knots of predetermined dimensions in said thread.

2. The apparatus of claim 1 wherein said knot detecting means comprising a slot in said thread inserter having a minimum width that is greater than the normal thickness of said thread but smaller than the knot to be detected.

3. The apparatus of claim 2 wherein the thread inserter includes a pivot means for rotating said inserter in a direction approximately perpendicular to the direction of travel of said thread.

4. The apparatus of claim 3 wherein said thread inserter includes a slough off means for guiding said thread into said fault sensing zone.

5. The apparatus of claim 4 wherein said thread inserter includes a magnetic means for biasing said inserter in a first position suitable for detecting said knots.

6. The apparatus of claim 5 wherein said magnetic means comprising a magnet and an extension on said pivot means adapted to come into contact with said magnet when said thread inserter is in said first position.

7. The apparatus of claim 6 further including a stop means for preventing the rotation of said thread inserter beyond a second position different from said first position.

* * * * *